US006592941B1

(12) United States Patent
Bayer et al.

(10) Patent No.: US 6,592,941 B1
(45) Date of Patent: Jul. 15, 2003

(54) ALUMINUM AND SILICON DIFFUSION COATING

(75) Inventors: George T. Bayer, Tarentum, PA (US); Kim A. Wynns, Spring, TX (US)

(73) Assignee: Alon, Inc., Tarentum, PA (US)

( * ) Notice: Subject to any disclaimer, the term of this patent is extended or adjusted under 35 U.S.C. 154(b) by 989 days.

(21) Appl. No.: 08/745,199

(22) Filed: Nov. 8, 1996

(51) Int. Cl.[7] ..... C23C 16/44; C23C 8/06; B05D 3/02

(52) U.S. Cl. ..... 427/253; 427/376.3; 427/376.4; 427/383.7; 148/279; 148/283

(58) Field of Search ..... 427/376.3, 376.4, 427/383.7, 253; 428/938, 941, 641, 650; 148/240, 279, 283

(56) References Cited

U.S. PATENT DOCUMENTS

| | | | | |
|---|---|---|---|---|
| 2,097,024 A | | 10/1937 | Walter | 148/14 |
| 4,310,574 A | | 1/1982 | Deadmore et al. | 427/405 |
| 4,500,364 A | | 2/1985 | Krutenat | 148/6.14 R |
| 4,687,684 A | * | 8/1987 | Restall et al. | 427/248.1 |
| 4,904,501 A | | 2/1990 | Davis | 427/253 |
| 4,929,473 A | * | 5/1990 | Marquez et al. | 427/252 |
| 5,135,777 A | * | 8/1992 | Davis et al. | 427/217 |
| 5,492,726 A | * | 2/1996 | Rose et al. | 427/252 |

FOREIGN PATENT DOCUMENTS

| | | |
|---|---|---|
| EP | 0 184 354 A | 6/1986 |
| EP | 0 294 987 | 12/1988 |
| FR | 1 377 238 | 2/1965 |
| FR | 2 030 314 | 11/1970 |
| FR | 2 511396 | 2/1983 |
| JP | 54090030 | 7/1979 |
| JP | 55 082768 | 9/1980 |

OTHER PUBLICATIONS

ASTM B 874 Standard Specification for Chromium Diffusion Coating Applied by Pack Cementation Process, Aug., 1996.

ASTM B 875 Standard Specification for Aluminum Diffusion Coating Applied by Pack Cementation Process, Aug. 1996.

* cited by examiner

*Primary Examiner*—Holly Rickman
(74) *Attorney, Agent, or Firm*—Buchanan Ingersoll, P.C.

(57) ABSTRACT

A method of forming an aluminum silicon diffusion coating on a surface of an alloy product utilizes a diffusion mixture containing by weight 1% to 5% aluminum, 0.5% to 5% silicon, 0.5% to 3% ammonium halide activator and the balance an inert filler. The product to be coated is placed in a retort with the diffusion mixture covering the product surfaces to be coated. Upon heating aluminum and silicon will diffuse onto the product surfaces forming the aluminum and silicon diffusion coating.

9 Claims, 1 Drawing Sheet

ALUMINUM AND SILICON DIFFUSION COATING

FIELD OF INVENTION

The invention relates to a method of diffusion coating an iron, nickel, cobalt, or copper base alloy with an aluminum and silicon containing coating diffused onto the surface of alloys using a pack cementation process and the insert used in that process.

BACKGROUND OF THE INVENTION

Pack cementation is a well known technique for applying diffusion coatings to metal surfaces. This process involves placing a pack mixture into close contact with the surface being coated and subsequently heating the entire assembly to an elevated temperature for a specified period of time. During heating the coating material diffuses from the pack onto the surface of the metal by a combination of chemical reactions and gas phase mass transport. Pack cementation is commonly used to apply aluminum diffusion coatings as well as to apply chromium diffusion coatings. A common pack mixture used to create a chromium coating contains chromium, an inert filler such as alumina, and a halide activator. Similarly a common pack mixture used to produce an aluminum coating consists of an aluminum source, a halide salt activator and an inert diluent or filler such as alumina. Davis in U.S. Pat. No. 4,904,501 teaches that ammonium chloride, sodium chloride and ammonium bromide can be used as activators.

Aluminum-silicon diffusion coatings are preferred over aluminum diffusion coatings for some applications because silicon in the coating improves hot corrosion and ash corrosion resistance and reduces brittleness of the coating. The art has developed several methods of applying an aluminum-silicon coating to ferrous metal articles. Most commercial processes that are used to apply aluminum-silicon diffusion coatings require separate diffusion steps for each element or use expensive masteralloys. Masteralloys of aluminum and silicon cost 3 to 4 times more than pure aluminum and twice as much as pure silicon on a weight basis. Consequently, those skilled in the art have been searching for a less expensive process, particularly one in which an aluminum-silicon diffusion coating is applied in a single step. Preferably, the process should not require any materials that are expensive or difficult to obtain. The process should be suitable for use on existing equipment and for large scale processing operations. Both U.S. Pat. Nos. 4,500,364 and 4,310,574 discloses processes in which a slurry coating is applied to the article followed by high temperature firing. Slurries are more difficult to handle than the more common powder mixtures used in most pack cementation processes. Japanese Patent application 54090030 discloses a process in which steel plate is buried in an agent comprised of aluminum powder, silica ($SiO_2$) powder and a halide and then heated at 1000° C. in a nonoxidizing atmosphere to apply an aluminum and silicon diffusion coating. Because of the low reactivity of the silica powder, the resulting coating would contain very little silicon. Therefore, the benefits of having silicon in an aluminum diffusion coating are not obtained.

SUMMARY OF THE INVENTION

We provide a method of diffusion coating iron-, nickel-, cobalt- and copper-based alloys by simultaneous deposition of aluminum and silicon coating using a pack mix containing pure aluminum, pure silicon and an ammonium halide activator. The components to be coated are placed in a carbon steel or high temperature alloy retort and the surfaces to be coated are covered by the pack mix. The retort may be heated to between 300° to 400° F. for one hour to remove any oxygen or moisture present. Then the retort is heated to an interior temperature of 1200° to 2100° F. and held at that temperature for a selected time period. That time period will depend upon the base alloy being coated and the required depth of the diffusion coating. After the selected heating period has passed the retort is rapidly cooled and opened. Then the aluminum-silicon diffusion coated parts are removed. The coated parts are then cleaned and, if desired, also grit blasted.

DESCRIPTION OF THE PREFERRED EMBODIMENTS

Figure 1:
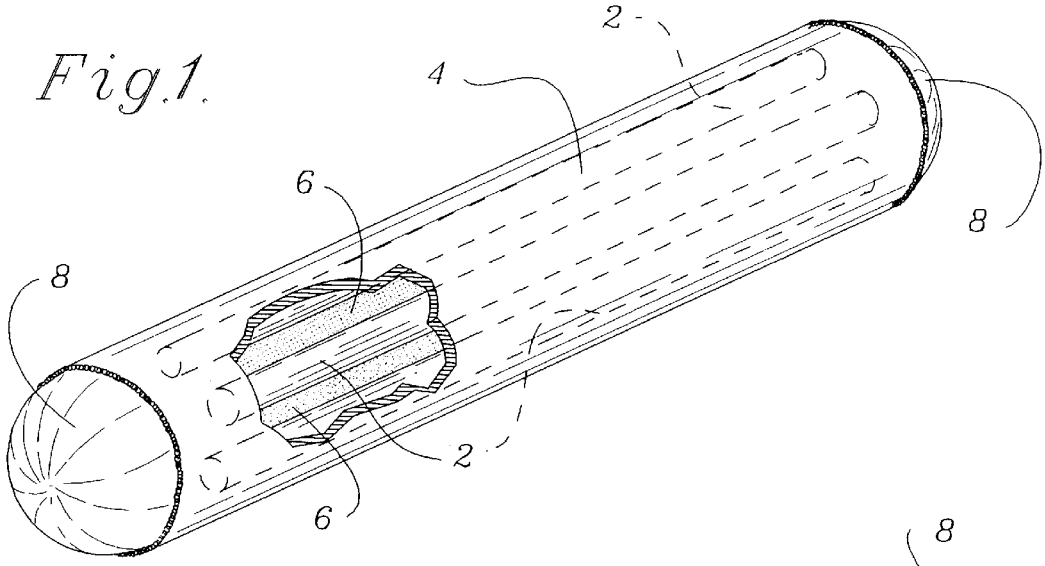
FIG. 1 is a perspective view of a retort partially cut away which contains tubular products and our pack for applying an aluminum silicon diffusion coating in accordance with a first preferred embodiment of our method.
Figure 2:
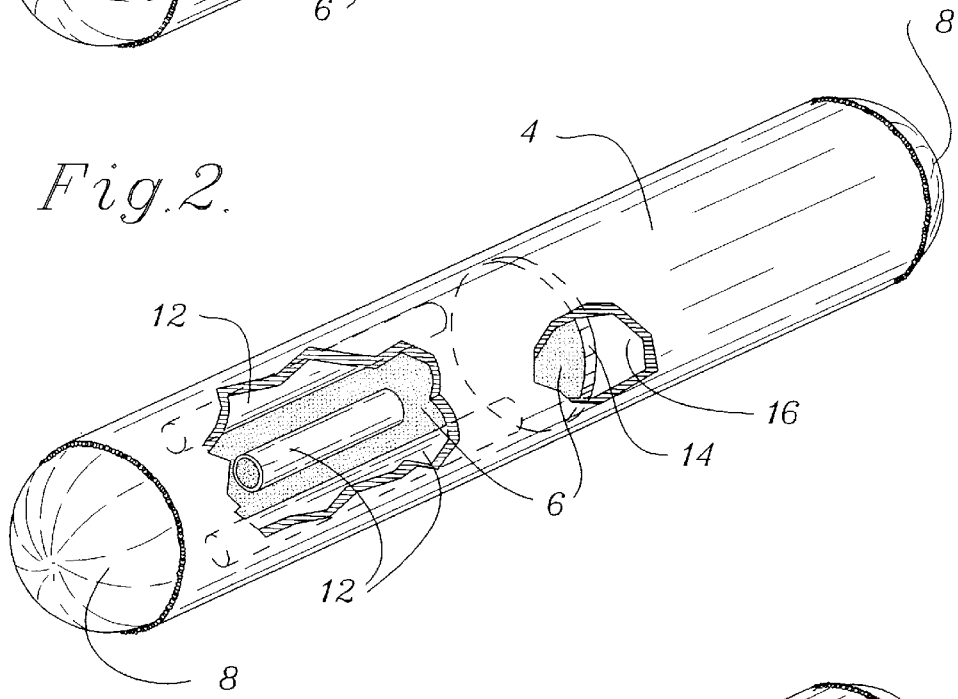
FIG. 2 is a perspective view similar to FIG. 1 of a retort partially cut away which contains tubular products and our pack for applying an aluminum silicon diffusion coating in accordance with a second preferred embodiment of our method.

We provide a method of applying an aluminum silicon diffusion coating on a surface of a workpiece formed from an iron-, nickel-, cobalt- or copper-based alloy by simultaneous deposition of aluminum and silicon coating using a pack mix containing pure aluminum, pure silicon and an ammonium halide activator. Our method could be used to coat both sheet and tubular stock as well as complex shapes or parts. In FIGS. 1 and 2 we illustrate the method being used to coat tubes. The components 2 to be coated are placed in a carbon steel or high temperature alloy retort 4 and are surrounded by the pack mix 6. In FIG. 1, the pack mix is a powder which has been packed inside and around the tubes 2 filling the retort 4. The ends of the retort are closed by lids 8 which may be welded or sand-sealed. It should be understood that the retort typically will have a cooling jacket, associated piping and vents not shown in the Figures. No introduced atmosphere is necessary. However, argon or argon-hydrogen mixtures can be used as a purge gas to provide an inert or reducing atmosphere. The retort may be first heated to between 300° to 400° F. for one hour to remove any oxygen or moisture present. Then the retort is heated to an interior temperature of 1200° to 2100° F. and held at that temperature for a selected time period. That time period should range from 5 to 45 hours and will depend upon the base alloy being coated and the required depth of the diffusion coating. After the selected heating period has passed the retort is rapidly cooled and opened. Then the aluminum-silicon diffusion coated parts are removed. The coated parts are then cleaned and, if desired, also grit blasted.

In the first preferred embodiment of our method illustrated by FIG. 1 we fill the retort with pack mix to surround the products being coated. The pack mix contains 1–5% aluminum, 0.5–5% silicon, 0.5–3% ammonium halide activator by weight and the balance being an inert filler such as aluminum oxide. Suitable activators are ammonium fluoride, ammonium chloride, ammonium bromide and ammonium iodide. The components being coated must be free of all dirt, oil, grease, paint, rust and mill scale. In the illustrated process the tubes 2 are filled with and surrounded by pack mix to provide a diffusion coating on both the inner walls and outer walls. When only the inside surface of tubes, complex shapes or parts are to be diffusion coated, it is possible to fill the tubes or other workpieces with pack mix covering only the inside surfaces. The pack mix is held in place by metal caps or an adhesive tape. The packed tubes or other workpieces can then be loaded into an empty retort and processing will be performed as described above. Since powder is only present in the tubes or other workpieces, improved heat transfer to them will be achieved. The product to be coated can be of any desired length and may include both straight portions and return bends.

EXAMPLE 1

Type 1018 carbon steel, type 304 austenitic stainless steel, and Alloy 800 (iron-base superalloy) samples were simultaneously diffusion coated with aluminum and silicon in a pack cementation process. The pack composition consisted of 4 wt. % aluminum, 0.5 wt. % silicon, 0.5 wt. % ammonium chloride, and 95 wt. % aluminum oxide. The process was conducted in a hermetically sealed carbon steel retort. The process consisted of heating the retort in a furnace at a temperature ranging from 1500° F.–1800° F. for 5 hours.

The diffusion coated samples were examined by standard metallographic techniques. The type 1018 carbon steel sample exhibited an average diffusion zone thickness of approximately 0.012" with no porosity and minimal grain boundary formation running perpendicular to the diffusion zone surface. Scanning electron microscopy/energy dispersive spectrometric measurements indicated a composition including 36.7 wt. % aluminum and 0.3 wt. % silicon at the diffusion zone surface. The type 304 austenitic stainless steel sample exhibited an average diffusion zone thickness of approximately 0.012" with no grain boundary formation and no porosity. The Alloy 800 sample exhibited an average diffusion zone thickness of 0.004" with no grain boundary formation and no porosity.

EXAMPLE 2

Samples of a 98 wt. % copper—2 wt. % beryllium alloy were simultaneously diffusion coated with aluminum and silicon in a pack cementation process. The pack composition consisted of 4 wt. % aluminum, 1 wt. % silicon, 1.5 wt. % ammonium chloride, and 93.5 wt. % aluminum oxide. The process was conducted in a hermetically sealed carbon steel retort. The process consisted of heating the retort in a furnace at a temperature ranging from 1470° F.–1500° for 5 hours.

The diffusion coated samples were examined by standard metallographic techniques. The copper-beryllium samples exhibited an average diffusion zone thickness of approximately 0.006", ranging between 0.004" and 0.008", with no porosity and minimal grain boundary formation running perpendicular to the diffusion zone surface. As this alloy is used for an erosive/wear environment, hardness measurements of the diffusion zone surface were obtained. The average hardness of the diffusion zone surface was found to be 66 on the Rockwell C scale.

It is not necessary to completely fill the retort with workpieces and pack mix. As shown in FIG. 2, the items 12 to be coated are much shorter than the retort 4. Consequently, the products 12 are placed in one end of the retort 4 and surrounded with pack mix 6. A protective ceramic fiber sheet 14 is placed on the top of the pack mix while the balance of the retort remains empty. The ceramic fiber sheet 14 holds the pack mix 6 in place during heating. The heating process is preferably performed in the same manner as was described for the first embodiment. This will result in an inert or reducing gas in the space 16 above the pack mix 6 and ceramic fiber sheet 14. Since less pack mix is used than in a fully packed retort, improved heat transfer to the pack components will be achieved.

Figure 3:
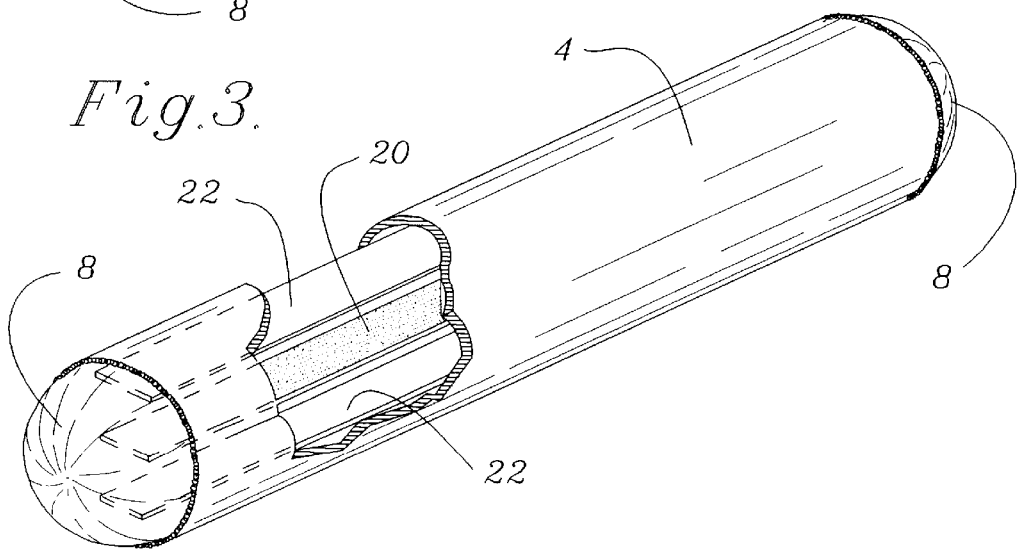
FIG. 3 is a perspective view similar to FIG. 1 where a pack mix is contained in a composite ceramic sheet placed adjacent to surfaces of plates to be coated.

In a third embodiment shown in FIG. 3 we provide a composite ceramic sheet 20 containing the proper proportions of aluminum, silicon, ammonium halide, aluminum oxide and binder. This sheet 20 is laid in the retort 4 adjacent to the plates or other components 22 to be coated. Then the retort is heated. Aluminum and silicon diffuse from the composite ceramic sheet 20 onto surfaces of plates 22 adjacent to the ceramic sheet 20 and the parts are further processed as described in the first embodiment.

If it is desired to coat only the inner surfaces of tubes or other hollow structure, one can use a ceramic insert containing the proper proportions of aluminum, silicon, ammonium halide, aluminum oxide and binder. The insert is placed into the tubes or other hollow structure whose inner walls are to be coated. The items containing inserts are capped or taped and loaded in a retort. The retort is heated as previously described to create a diffusion coating on the inner walls of the tubes or other hollow structure in the retort. Thereafter, the tubes are removed from the retort and the insert is removed from the tubes. The tubes can then be cleaned, grit blasted or subjected to other treatments. The use of such ceramic insert should provide faster heating of the items to be coated. Also, the insert and coated articles cool faster than a retort which is completely filled with powder as illustrated in FIG. 1. We have observed that a non-uniform temperature distribution can occur in the components in a retort packed as in FIG. 1. Use of an insert should minimize the effects of this condition.

While we have described and illustrated certain present preferred embodiments of our pack mix and methods for applying an aluminum silicon diffusion coating, it should be distinctly understood that our invention is not limited thereto, but may be variously embodied within the scope of following claims.

We claim:

1. A method of coating a surface of an alloy product comprising:

a. preparing a diffusion mixture consisting essentially of by weight 1% to 5% aluminum, 0.5% to 5% silicon, 0.5% to 3% ammonium halide activator and the balance an inert filler;

b. placing the diffusion mixture in a retort with the alloy product to be coated so that the diffusion mixture covers those surfaces of the product which are to be coated; and c. heating the retort to a sufficiently high temperature to cause aluminum and silicon in the mixture to diffuse onto at least one surface of the alloy product forming an aluminum silicon coating.

2. The method of claim 1 wherein the retort is heated to an interior temperature of from 1200° to 2100° F.

3. The method of claim 2 also comprising the step of injecting argon gas into the retort.

4. The method of claim 3 also comprising the step of injecting hydrogen with the argon gas into the retort.

5. The method of claim 1 wherein the coating is applied by surface chemical diffusion from at least one of a ceramic composite sheet and a ceramic composite insert which contains the diffusion mixture.

6. The method of claim 1 wherein the activator is selected from the group consisting of ammonium fluoride, ammonium chloride, ammonium bromide, and ammonium iodide.

7. The method of claim 1 wherein the diffusion mixture fills only a portion of the retort.

8. The method of claim 7 wherein the diffusion mixture is a powder.

9. The method of claim 1 wherein the inert filler is aluminum oxide.

* * * * *